United States Patent [19]

Yarnell

[11] Patent Number: 4,487,052

[45] Date of Patent: Dec. 11, 1984

[54] DEVICE AND METHOD FOR REMOVING IRREGULARITIES IN OR ENLARGING AN UNDERGROUND DUCT

[76] Inventor: Ian R. Yarnell, Unit 106B Blackdown Industries, Haste Hill, Haslemere, Surrey GU27 2HA, England

[21] Appl. No.: 504,603

[22] Filed: Jun. 15, 1983

[30] Foreign Application Priority Data

Jun. 18, 1982 [GB] United Kingdom ..... 8217645

[51] Int. Cl.[3] ..... B21D 41/02

[52] U.S. Cl. ..... 72/393; 15/104.3 SN; 72/370; 254/134.3 FT

[58] Field of Search ..... 269/48.1; 82/392; 72/370, 393, 399; 15/104.3 SN, 104.3 R; 254/134.3 FT, 134.4

[56] References Cited

U.S. PATENT DOCUMENTS

| | | | |
|---|---|---|---|
| 1,035,994 | 8/1912 | Mueller | 254/134.4 |
| 2,508,659 | 5/1950 | Brown | 15/104.3 R |
| 3,107,379 | 10/1963 | Hill | 254/134.4 |
| 3,690,141 | 9/1972 | Brownbill | 73/370 |

*Primary Examiner*—W. D. Bray

*Attorney, Agent, or Firm*—John J. Byrne; Bradford E. Kile; Kevin M. O'Brien

[57] ABSTRACT

A device for removing irregularities in or enlarging a buried duct comprises a cylindrical housing (10) corresponding approximately in diameter to the required diameter of the duct, a plurality of tapered leaf members (14) pivotally attached at their rear ends to the front of the housing, and a conical wedge (18) driven by an axial hydraulic ram (12) mounted inside the housing (10). In operation, the apparatus is drawn through the duct with the leaf members (14) in a retracted position in which they form a tapered nose portion, until an irregularity in the duct causes resistance to forward movement. The ram (12) is operated to force the leaf members outwardly against the wall of the duct to remove the irregularity. The leaf members (14) are then retracted as the apparatus is drawn forward to the next obstruction. The apparatus is particularly intended for preparing damaged sewers prior to fitting an inner, lining pipe.

15 Claims, 6 Drawing Figures

DEVICE AND METHOD FOR REMOVING IRREGULARITIES IN OR ENLARGING AN UNDERGROUND DUCT

This invention relates to a device for profiling an underground duct, for example an underground sewer which is to be repaired by fitting an inner pipe lining.

In many of the developed industrial countries of the world, underground sewers have to a large extent reached an age at which they are in a state of severe disrepair and liable to collapse. One method of repairing sewers is to line the existing sewer pipe internally with plastics pipe sections or an expandable plastics sleeve. However, the condition of the original sewer is often such that the original earthenware pipe sections are displaced relative to each other or have already partly collapsed as shown in FIG. 1 of the accompanying drawings. In these circumstances the diameter of an inner pipe lining made up of rigid plastics pipe sections is limited over the length of sewer being repaired to that determined by the worst irregularity in that length. The result is that the flow capacity of the repaired sewer may be considerably reduced. Attempts have been made to hammer out the irregularities with a remotely controlled machine, but this has proved difficult to control and can worsen the state of collapse.

It is an object of this invention to provide apparatus able largely to correct the irregularities in an existing sewer in a relatively controllable and reliable manner.

According to a first aspect of this invention, a device for removing irregularities in or enlarging a buried duct comprises: a base member shaped to engage the wall of the duct; a plurality of leaf members in the region of an end of the base member and arranged substantially symmetrically around a central longitudinal axis, each leaf member being mounted for movement transversely with respect to the longitudinal axis; a longitudinally mounted ram; and means connecting the ram to the leaf members so that operation of the ram causes the leaf members to move outwardly away from the axis to bear against the wall of the duct.

In a preferred embodiment of the invention, the leaf members are pivotable between a retracted position in which their outer surfaces together form a tapered nose portion, and an expanded position in which their outer surfaces together form a substantially cylindrical surface corresponding to the required size of the duct. The connecting means which is preferably in the form of a cone with guide rails for the leaf members, is movable hydraulically by the ram, which is mounted in the base member. According to the second aspect of the invention, there is provided a method of removing irregularities in or enlarging a buried duct by remote control, comprising: (i) providing a remotely controlled device inside the duct, the device comprising a base member, a plurality of leaf members arranged symmetrically around a longitudinal axis of the device and coupled to the base member, and expander means longitudinally movable relative to the base member for moving the leaf members between a retracted position in which they form a tapered nose portion and an expanded position in which they form a substantially cylindrical surface corresponding to the required size of the duct; (ii) providing means for remotely controlling movement of the wedge and means for driving the device along the duct; (iii) driving the device through the duct with the leaf members leading and in their retracted position; (iv) when resistance to movement of the device reaches a given level, remotely expanding the leaf members to push the wall of the duct outwardly to reduce the resistance to movement; (v) returning the leaf members to their retracted position, and repeating steps (iii) and (iv) until the required length of duct has been transversed. The device may be driven through the duct by repeatedly operating a hydraulic ram at an accessible location, the ram being alternately connected and disconnected during each operating stroke to a chain or wire connected to the device through the duct. In this way the wall portion is forced into the material surrounding the duct until the internal diameter of the duct at that location corresponds generally to the original diameter, or, when required, to a larger diameter determined by the diameter of the device. Depending on the nature of the duct and the material surrounding it, it may be possible to enlarge or profile much of the duct merely by drawing the device through the duct with sufficient force. However, in most cases it is necessary periodically or continuously to expand the leaf members for forward movement to be maintained.

The invention will now be described by way of example with reference to FIGS. 1 to 6 of the drawings in which.

Figure 1:
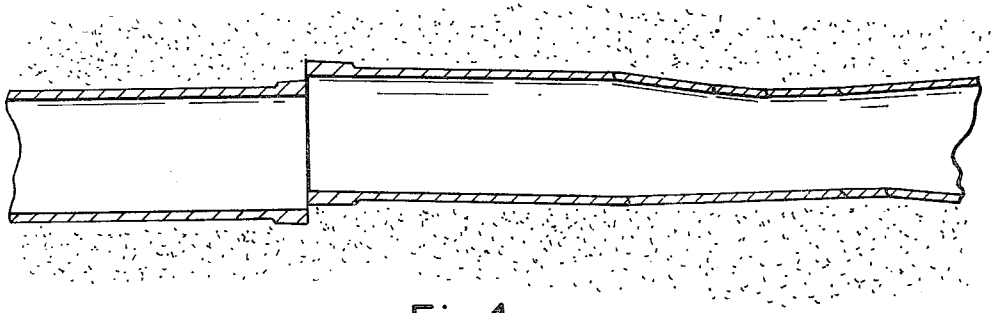
FIG. 1 is a cross section of a duct to be repaired.
Figure 2:
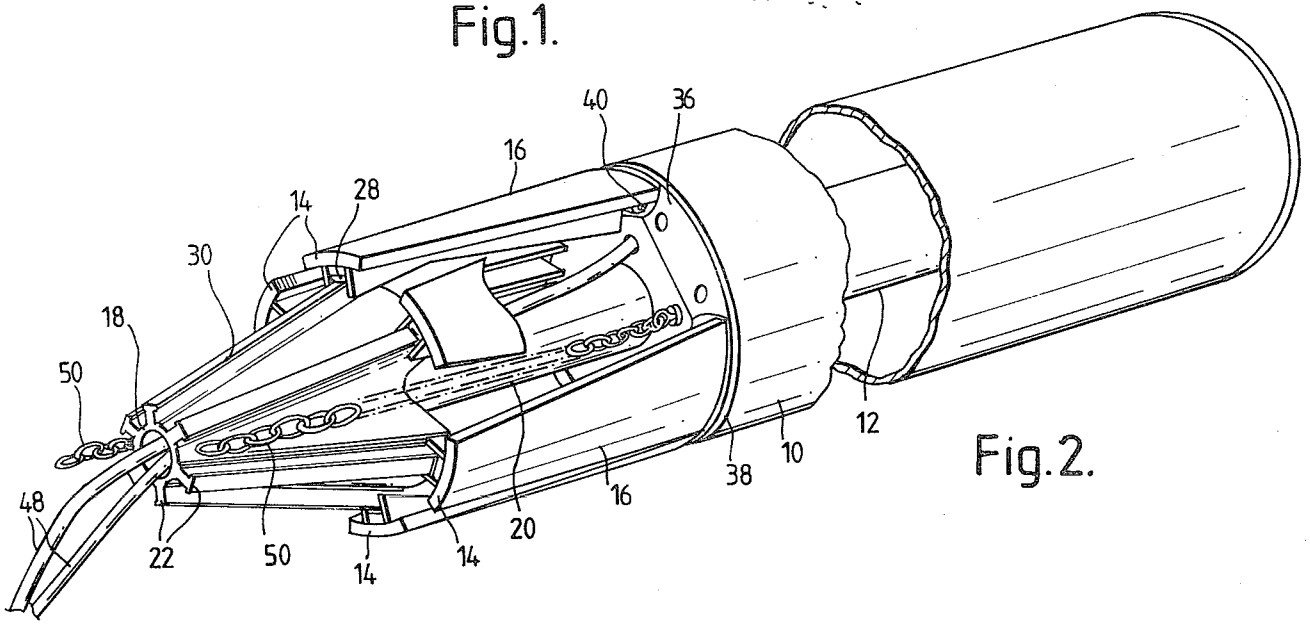
FIG. 2 is a perspective view of a device in accordance with the invention with leaf members in an expanded position.
Figure 3:
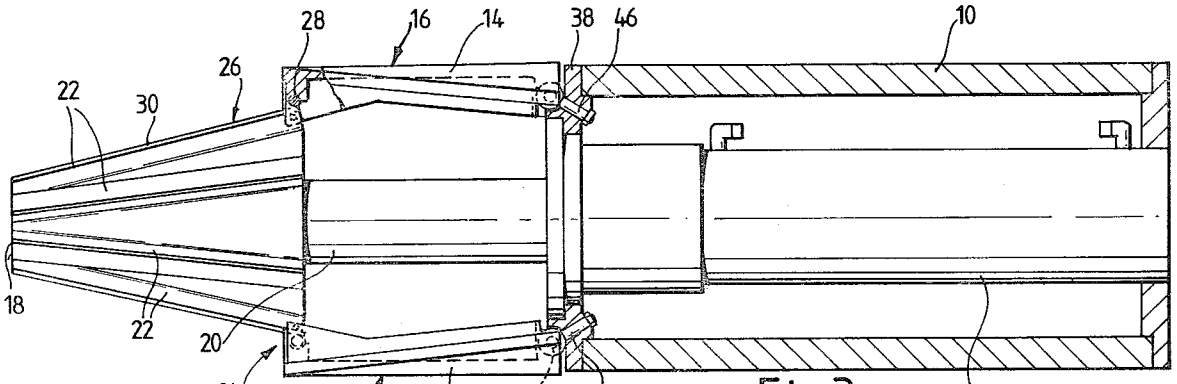
FIG. 3 is a cut away side elevation of the device with a ram housing shown in section, and with leaf members again in their expanded position.
Figure 4:
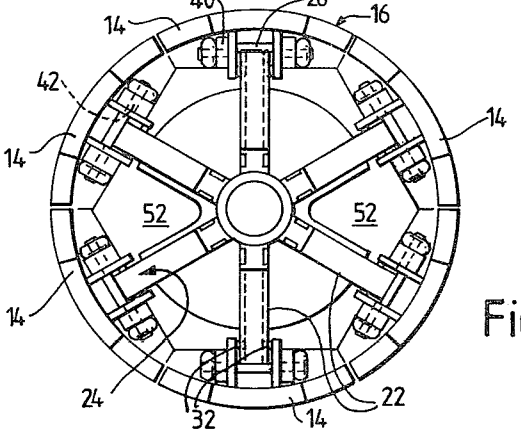
FIG. 4 is an end elevation of the device.
Figure 5:
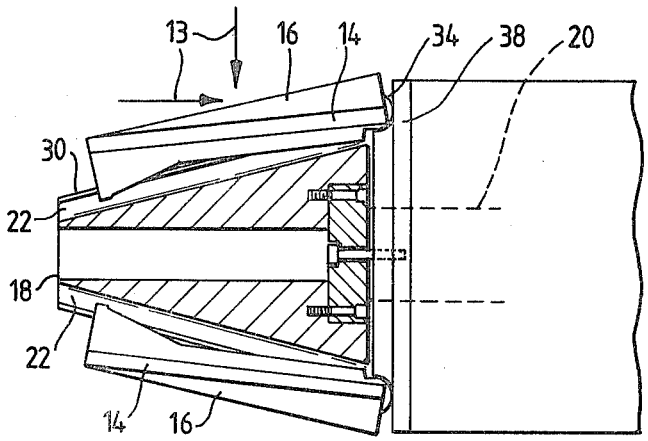
FIG. 5 is a side elevation of part of the device, showing the leaf members in their retracted position.

Referring to FIGS. 2 to 5 of the drawings, the preferred embodiment of the invention comprises a cylindrical base member 10 which acts as a housing for a longitudinally mounted double-acting ram 12. The diameter of the base member 10 corresponds approximately to the required internal diameter of the duct so that the device can be positioned in the duct with its longitudinal axis substantially coincident with the axis of the duct. Attached to front end of the base member 10 are six tapered leaf members 14 arranged in annular fashion symmetrically around the longitudinal axis. Each leaf member 14 has a part conical outer surface 16 and is pivotally mounted at its rear, proximal end to the base member 14 so that it is pivotable about a respective transverse axis. The transverse axes together form a regular polygon perpedicular to the longitudinal axis, in this case a hexagon. A generally conical expander wedge 18 is mounted on the piston rod 20 of the ram 12 for moving the leaf members 14 between a first, retracted position (FIG. 5) in which the leaf members 14 form a conical nose portion, and a second, expanded position in which their outer surfaces 16 constitute a generally cylindrical outer shell forming a continuation of the other surface of the base member.

Guide rails 22 on the wedge 18 locate in channels 24 formed in the undersides of the leaf members 14, and the outer surfaces 26 of the rails are engaged by rollers 28 trapped in recesses at the front ends of the leaf members 14. Each rail 22 has a flange 30 so that a pair of studs 32 (FIG. 4) fixed in each leaf member 14 and located under the flange retains the front end of the leaf member on the rail 22. It will be appreciated that when the leaf members 14 are under load, as is the case when the device is being drawn through the undersize or collapsed duct, or when the ram 12 is operated to force the duct wall outward, considerable inwardly and rearwardly directed forces 13 are exerted on the leaf members 14, and in turn on the base member 10 through the pivoted connections at the rear ends of the leaf members 14. These forces are transmitted between a transverse, convex, part-cylindrical bearing surface 34 (FIG. 5) on the rear end of each leaf member 14, and a concave part-cylindrical bearing surface 36 (FIG. 2) of corresponding radius machined in an annular end portion 38 of the base member 10. The end portion 38 has six such bearing surfaces 36 arranged in a hexagon around its perimeter. The leaf member bearing surface 36 is provided by a transverse steel bar 40 (FIGS. 2 and 4) welded to the rear end of the respective leaf member. For each leaf member 14 two pins 42 (FIG. 2 and FIG. 3) received in a bolt bored through the bar 40, locate in the eyes of two inclined bolts 46 (FIG. 3) secured in the end position 38 of the base member 10. The pins 42 serve only to retain the leaf member on the base member 10; they are a loose fit in the bolt eyes, the compression forces under load being transmitted through the bearing surfaces referred to above.

Figure 6:
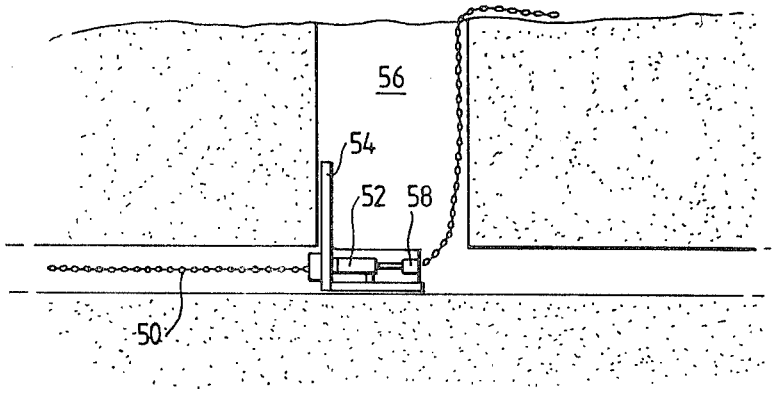
FIG. 6 is a diagrammatic section showing means for applying a pulling force to a chain at one end of an underground duct.

Hydraulic supply pipes 48 for the ram 12 pass through the end portion 38 of the base member 10 and through the interior of the wedge 18. Chains 50 for drawing the device through the duct are attached to the base member 10 and pass through a pair of recesses 52 (FIG. 4) in the outer surface of the wedge 18, although in an alternative embodiment (not shown) the chains may be attached instead to the front end of the wedge 18. Referring to FIG. 6, the chains 50 are fed along the duct to a drive ram 52 mounted in a stationery frame 54 bearing against the side of, for example, a manhole 56. To pull the apparatus through the duct, the ram 52 is reciprocated back and forth repeatedly, the piston rod of the ram 52 being alternately connected and disconnected with the chain 50. A ratchet device 58 holds the chain 50 in tension between each stroke of the ram 52. A pair of rams may be used in place of the single ram 52.

In operation the remotely controllable device shown in FIGS. 2 to 5 and the drive mechanism shown in FIG. 6 act together as follows.

The remote controllable device is positioned in the duct at the beginning of the stretch to be traversed and chains 50 are passed through the duct together with the hydraulic supply pipes 48 to the manhole 56. The chains 50 are secured to the drive mechanism and the pipes 48 connected to external control means (not shown) in the vicinity of the manhole. With the leaf members 14 in the retracted position, the remotely controllable device is drawn along the duct, nose portion leading, so that the walls of the duct are forced into the surrounding soil wherever they intrude inside the diameter of the base member 10. Depending on the nature of the duct and the soil around it, the pulling force which can be exerted by the ram 52 and the chain 50 may be insufficient to draw the device past certain locations. This condition is sensed at the control location by monitoring movement of the chains 50 or the fluid pressure in the ram 52. To remove the obstruction, a significantly larger compression force can now be applied to the wall of the duct by operating the ram 12. By maintaining tension in the chains 50, the remotely controllable device will begin to move forward again when the leaf members 14 are retracted. Thus, by a continuation of pulling and expansion steps the device is drawn through the duct eventually to the manhole 56, leaving a passage of a diameter sufficient to accept a plastics lining of required diameter. Conveniently, the device may be used to draw pipe lining sections behind it as it progresses through the duct.

To allow fluids to continue to pass through the duct when the remotely controllable device is being used, the device may include a passage conneting the front end to the rear end. In this case, the ram 12 may be replaced by a plurality of rams spaced around the axis, leaving a clear axial passage through the device.

I claim:

1. A remotely controllable device for removing irregularities in or enlarging a buried duct, comprising: a base member shaped to engage the wall of the duct; a plurality of leaf members in the region of an end of the base member and arranged substantially symmetrically around a central longitudinal axis, each leaf member being mounted for movement transversely with respect to the longitudinal axis; a longitudinally mounted ram; and means connecting the ram to the leaf members so that operation of the ram causes the leaf members to move outwardly away from the axis to bear against the wall of the duct.

2. A device according to claim 1, wherein each leaf member has a front end and a rear end, each leaf member being pivotally mounted at its rear end on the base member for pivotal movement about a respective transverse axis, and wherein the connecting means comprises an expander wedge which is longitudinally movable relative to the base member for forcing the front ends of the leaf members outwardly against the wall of the duct.

3. A device according to claim 2, wherein the ram is a hydraulic ram.

4. A device according to claim 3, wherein the ram is mounted on the base member and the wedge is mounted on a piston rod of the ram.

5. A device according to claim 2, wherein the wedge is substantially conical in shape and includes means for guiding the front end of each leaf.

6. A device according to claim 2, wherein each leaf member has a convex cylindrical bearing surface at its rear end, and wherein the base member has a plurality of concave cylindrical bearing surfaces of corresponding radius for engaging the said bearing surfaces and supporting the leaf members when under load.

7. A device according to claim 1, including at least four leaf members, each of which is tapered towards its front end.

8. A device according to claim 7, wherein the base member comprises a cylindrical housing surrounding a hydraulic ram, and wherein each leaf member has a curved outer surface, the radius of curvature at the rear end of the leaf member corresponding substantially to the outer radius of the housing.

9. A device according to claim 5, wherein the guiding means comprises a plurality of longitudinal guide rails having outer bearing surfaces lying in a notional frustoconical surface centred on the said longitudinal axis.

10. A device according to claim 9, wherein each leaf member has a roller at its front end for engaging the outer bearing surface of a respective rail.

11. A device according to claim 10, wherein each leaf member has an inwardly directed longitudinal channel for receiving a respective guide rail.

12. A device according to claim 11, wherein each of the guide rails has an outer flange and wherein each leaf member is provided with projections at the front end of the channel for engaging the underside of the respective flange.

13. A method of removing irregularities in or enlarging a buried duct by remote control, comprising: (i) providing a remotely controlled device inside the duct, the device comprising a base member, a plurality of leaf members arranged symmetrically around a longitudinal axis of the device and pivotally attached to the base member, and a tapered expander member longitudinally movable relative to the base member for moving the leaf members between a retracted position in which they form a tapered nose portion and an expanded position in which they form a substantially cylindrical surface corresponding to the required size of the duct; (ii) providing means for remotely controlling movement of the wedge and means for driving the device along the duct; (iii) driving the device through the duct with the leaf members leading and in their retracted position; (iv) when resistance to movement of the device reaches a given level, remotely expanding the leaf members to push the wall of the duct outwardly to reduce the resistance to movement; (v) returning the leaf members to their retracted position, and repeating steps (iii) and (iv) until the required length of duct has been traversed.

14. A method according to claim 13, in which the device is driven through the duct by repeatedly operating a hydraulic ram at an accessible location, the ram being alternately connected and disconnected during each operating stroke to a chain or wire connected to the device through the duct.

15. Apparatus for profiling an underground duct by remote control including the device of claim 1, means for remotely operating the device, a chain or wire attached to the device, and drive means attached to the chain or wire for drawing the device through the duct.

* * * * *